United States Patent [19]

Ito et al.

[11] 4,050,638

[45] Sept. 27, 1977

[54] RADIOACTIVE MATTER CONTAINING WASTE GAS TREATING INSTALLATION

[75] Inventors: Isao Ito, Nagoya; Yoichi Karita, Handa, both of Japan

[73] Assignee: NGK Insulators, Ltd., Nagoya, Japan

[21] Appl. No.: 570,079

[22] Filed: Apr. 21, 1975

[30] Foreign Application Priority Data

| | | |
|---|---|---|
| Apr. 24, 1974 | Japan | 49-45926 |
| May 8, 1974 | Japan | 49-51738 |
| May 8, 1974 | Japan | 49-50809 |

[51] Int. Cl.[2] ..... G21C 19/14

[52] U.S. Cl. ..... 241/222; 176/37; 214/1 CM

[58] Field of Search ..... 214/1 BB, 18 N, 650 R, 214/658, 1 CM, 1 R; 212/14, 10, 11; 176/30, 37; 241/222, 227

[56] References Cited

U.S. PATENT DOCUMENTS

| | | | |
|---|---|---|---|
| 1,296,756 | 3/1919 | Buculey | 212/10 |
| 3,267,830 | 8/1966 | Van Gaasbeek | 214/1 CM X |
| 3,482,711 | 12/1969 | Böhme et al. | 214/1 CM |
| 3,567,578 | 3/1971 | Isaac | 214/18 N X |
| 3,815,761 | 6/1974 | Adam | 214/1 CM |

*Primary Examiner*—Frank E. Werner

[57] ABSTRACT

Maintenance apparatuses for and improvements in a radioactive matter containing waste gas treating installation, which is capable of completely carrying out waste gas cleaning by means of ceramic filter element is disclosed. The installation is provided with at least one of the following three apparatuses or devices, i.e.

a ceramic filter element exchange apparatus which is capable of preventing radioactive contamination caused by scattering of radioactive dust at the time of inspecting or exchanging the filter element and preventing an operator from being subjected to radiation internal exposure as well as rapidly exchanging a spent filter element for a new one by remote control;

a ceramic filter element treating apparatus which can pulverize the spent filter element by mechanical power instead of human power in a short time so as to considerably reduce the spent ceramic filter element in volume and change it into a form which can easily be solidified; and a device having a sealed joint structure which is capable of securing the filter element to a support plate in a reliable and sealed manner by remote control.

11 Claims, 7 Drawing Figures

RADIOACTIVE MATTER CONTAINING WASTE GAS TREATING INSTALLATION

BACKGROUND OF THE INVENTION

1. Field of the Invention

This invention relates to improvements in a radioactive matter containing waste gas treating installation and more particularly to improved apparatuses for treating waste gas containing radioactive matter which is produced in the case of incinerating combustible radioactive waste delivered from atomic energy installations such, for example, as an atomic energy research laboratory, atomic power plant, nuclear fuel treating installation, nuclear fuel reprocessing work and radioactive isotope treating installation and the like.

2. Description of the Prior Art

Recent increase of atomic energy installations results in that the amount of radioactive waste is increased and hence large and many storage houses are required. In addition, it is not desirous to store the radioactive waste as it was just delivered from the atomic energy installations for the sake of safety.

As a result, the combustible radioactive waste is incinerated so as to considerably reduce its volume and ashes remained are solidified with the aid of cement or asphalt so as to make these ashes chemically stable. Such treating method is optimum from both econimical and safe standpoints. For this purpose, apparatuses for incinerating the combustible radioactive waste are widely established recently.

In such kind of apparatus for incinerating the combustible radioactive waste, it is important to completely incinerate the radioactive waste and remove the radioactive dust from the waste gas. In order to effect after burning of unincinerated components contained in the waste gas and at the same time remove the radioactive dust contained in the waste gas, a ceramic filter is widely used.

The ceramic filter has advantages that it can be used at a high temperature of the waste gas delivered from an incinerator, and that it can not only remove the radioactive dust but also effect after burning of the unincinerated components which have not sufficiently been incinerated in the incinerator. As a result, the ceramic filter is significantly usable in an apparatus for treating the waste gas delivered from the incinerator for incinerating radioactive waste.

The ceramic filter, however, has disadvantages that a ceramic filter element becomes clogged with the radioactive matter or so degraded in its mechanical strength that it is fallen down from its support plate after a long-time use. In order to avoid such disadvantages, it is necessary to exchange a spent filter element for a new one and also treat the spent filter element. In this case, the radioactive dust is deposited on the outer surface of the spent filter element and in addition the inside wall of a filter chamber is contaminated with the radioactive dust so that the spent filter element must also be treated as the radioactive waste. In exchanging the spent filter element for the new one, there exists such countermeasure that the operator is not subjected to such internal exposure as he absorbs the radioactive dust and that the radioactive contamination caused by scattering of the radioactive dust does not occur. In addition, the operator is required to exchange the spent filter element for the new one in a short time without approaching too near the spent filter element for fear that the operator should be subjected to unnecessary external exposure.

Heretofore, it has been the common practice to evacuate the filter chamber from its lower part so as to make slightly vacuum therein or maintain a reduced pressure which is slightly lower than the atmospheric pressure therein, thereby preventing the radioactive dust from being scattered from the filter chamber toward the upper part thereof, and exchange the spent filter element for the new one by an operator who wears a dust mask. Such measure, however, has disadvantages that in any case it is not possible to avoid scattering of a minute amount of radioactive dust into the operating house and hence the radioactive contamination is liable to be occurred, and that the exchange of the spent filter element for the new one becomes troublesome in operation since the operator must wear the dust mask.

A method of exchanging the spent filter element for the new one with the aid of the filter chamber which is provided at its upper part with a glove box has also been proposed. This method is capable of suppressing the scattering of the radioactive dust, but has disadvantages that it is troublesome in operation and requires a relatively long operating time, and that the operator must approach too near the radioactive matter to disregard the external exposure dose.

As a method of treating the spent filter element, heretofore, it has been the common practice to pulverize the spent filter element by means of a hammer in a glove box mounted at the lower part of the filter chamber, enclose the spent filter element thus pulverized in a storage container mounted at the lower part of the glove box and then solidify it with the aid of a cement, and finally store in a storage house.

This method, however, has disadvantages that the spent ceramic filter element is required to be pulverized by a human power, that the use of the glove box makes the operation difficult and requires a labor for a long time, that there is a risk of the operator being subjected to the external exposure by his position near the radioactive matter, that it is difficult to finely pulverize the ceramic filter element so that use must be made of a coarse ceramic which could not be densely enclosed in a storage container, and that such coarse ceramic not only could not sufficiently reduce its volume but also is difficult to sufficiently mix with cement when it is solidified.

In FIG. 6 is shown a typical waste gas treating installation which makes use of the above mentioned ceramic filter device and is capable of purifying waste gas containing radioactive matter. The installation shown in FIG. 6 is composed of a filter chamber 1 which is provided at its inner upper part with a support plate 2 from which are suspended downwardly a number of filter elements 3.

In FIG. 7 is shown one of these ceramic filter elements 3 downwardly suspended from the support plate 2. As shown in FIG. 7, the ceramic filter element 3 is provided at its top end with a flange 4 and an asbestos layer 5 sandwiched between the flange 4 and the support plate 2 in a sealed manner. The waste gas containing radioactive matter and delivered from an incinerator (not shown) is introduced through an inlet 6 into the filter chamber 1 and filtered by the ceramic filter elements 3. Unincinerated components contained in the waste gas are adhered to the surface of the ceramic filter elements 3 and then subjected to after burning at a temperature of 500° C to 1,000° C on the surface of the filter chamber 1. Both the filtration and after burning cause the waste gas to be purified and made harmless. The pure and harmlss gas thus treated is exhausted from an outlet 7.

Such prior art waste gas treating installation, however, has disadvantages that the use of asbestos for sealing a gap formed between the support plate 2 on the one hand and the ceramic filter element 3 and its upper flange 4 on the other hand requires a long time for exchanging the spent ceramic filter element 3 for the new one, that it is difficult to mechanize such exchange operation, and that if the asbestos is not uniformly compacted into the gap, the radioactive dust is liable to be leaked into the outlet 7, thereby producing dangerous radioactive contamination.

SUMMARY OF THE INVENTION

A main object of the invention, therefore, is to provide an improved installation for completely treating waste gas containing radioactive matter.

Another object of the invention is to provide a ceramic filter element exchange apparatus for a radioactive matter containing waste gas treating installation, in which the apparatus can prevent radioactive contamination caused by scattering radioactive dust and prevent an operator from being subjected to radiation internal exposure and at the same time rapidly exchange a spent ceramic filter element for a new one by remote control.

A further object of the invention is to provide a ceramic filter element treating apparatus for a radioactive matter containing waste gas treating installation, in which the apparatus can mechanically finely pulverize a spent ceramic filter element in a short time without relying on human power so as to considerably reduce in volume and change the spent ceramic filter element into a form which can easily be solidified.

A still further object of the invention is to provide an improved radioactive matter containing waste gas treating installation, comprising a device having a sealed joint structure which can mount a ceramic filter element on a support plate by remote control in a reliable and sealed manner.

The invention will be more fully understood by reference to the following detailed specification and claims taken in connection with the appended drawings.

Dimensions of certain of the parts as shown in the appended drawings may have been modified and/or exaggerated for the purpose of clarity of illustration.

DETAILED DESCRIPTION OF THE INVENTION

The ceramic filter element exchange apparatus, according to the invention, for a radioactive matter containing waste gas treating installation comprises a filter element exchange air tight box means having a filter element supplying box and a sight glass, a travelling crane means driven by driving shaft means arranged in the upper part of the box means so as to be moved in forward and backward directions as well as left and right directions, and a lift up means carried by the travelling crane means and for suspending a chuck for holding a filter element and raising and lowering it, whereby the filter element is exchanged for a new one while observing through the sight glass by remote control.

The installation carries out waste gas cleaning by means of ceramic filter elements, and the apparatus is closely and detachably mounted on the installation.

Figure 1:
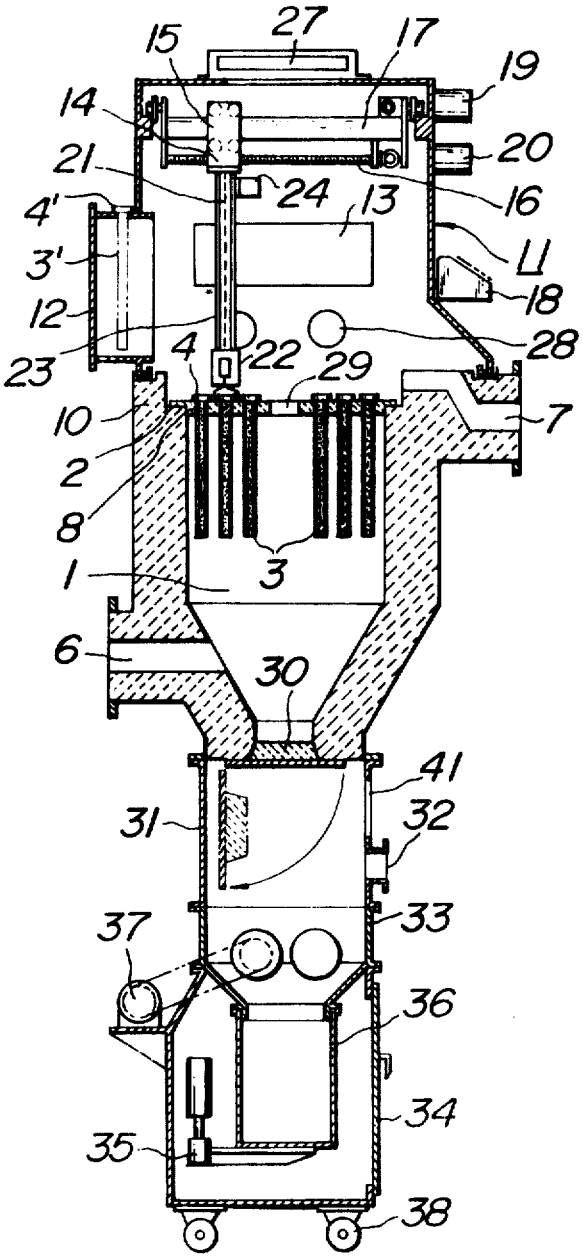
FIG. 1 shows a longitudinal section through one embodiment of a radioactive matter containing waste gas treating installation provided with apparatuses and devices according to the invention.

In FIG. 1 is shown one embodiment of the exchange apparatus according to the invention mounted on the installation.

Figure 6:
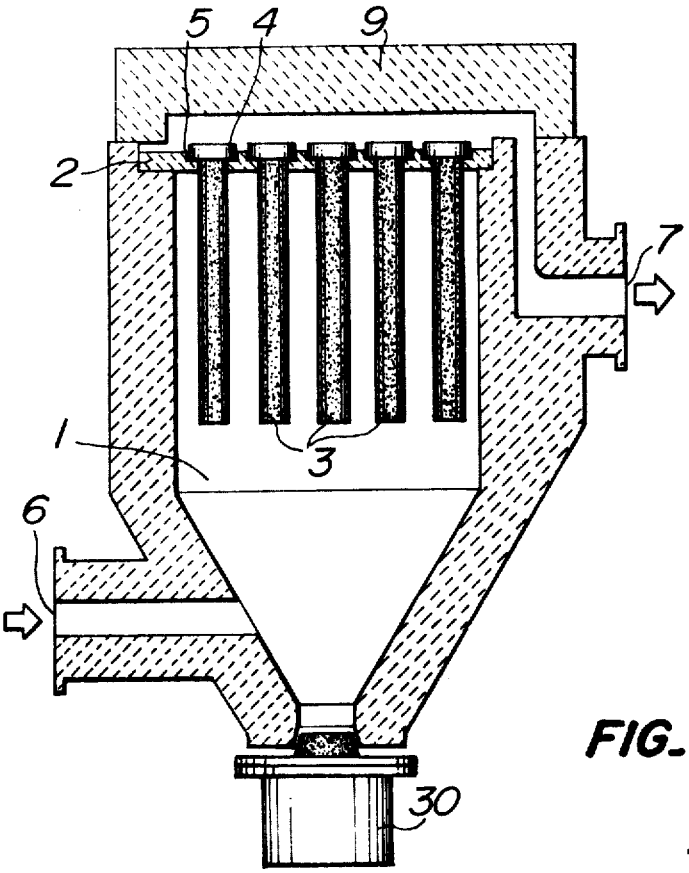
FIG. 6 shows a longitudinal section through a radioactive matter containing waste gas treating installation.
Figure 7:
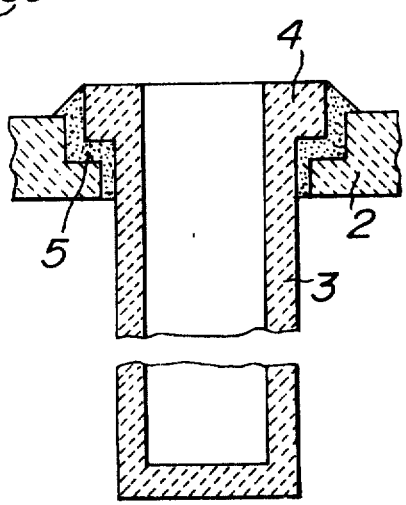
FIG. 7 is a vertical section showing that part of the ceramic filter element shown in FIG. 6 which is mounted on a support plate.

A radioactive matter containing waste gas treating installation shown in FIGS. 1 and 6, is composed of a filter chamber 1 in which are enclosed a number of ceramic filter elements 3. These filter elements 3 are arranged in the upper part of the filter chamber 1 and each extended air tightly through an element setting hole 8 provided in a suport plate 2 and suspended downwardly therefrom. The radioactive matter containing waste gas introduced from a waste gas inlet 6 into the filter chamber 1 is filtered by the ceramic filter elements 3 to purify the waste gas. The waste gas thus purified is exhausted from a waste gas outlet 7.

A ceramic filter element exchange apparatus shown in FIG. 1 is air tightly provided on a seal face 10 of the installation with a filter element exchange air tight box means 11. The box means 11 is provided with a filter element supplying box 12 and a sight glass 13, both the filter element supplying box 12 and the sight glass 13 being hermetically sealed with the box means 11. The box means 11 is also provided at its upper part with driving shaft means 16, 17 which can move a lift up means 14 carried by a travelling crane means 15 in forward and backward as well as in left and right directions. The driving shaft means 16, 17 are rotated by means of driving motors 19, 20, respectively adapted to be controlled by a switch box 18. From the lift up means 14 is suspended downwardly through a chain 21 a chuck 22 for holding the filter element 3 and raising and lowering it. The chain 21 is surrounded by a chain guide 23 so as to prevent the chain 21 from being transversely swung. The chain 21 is raised and lowered by means of a chain driving motor 24 adapted to be controlled by the switch box 18.

Figure 2:
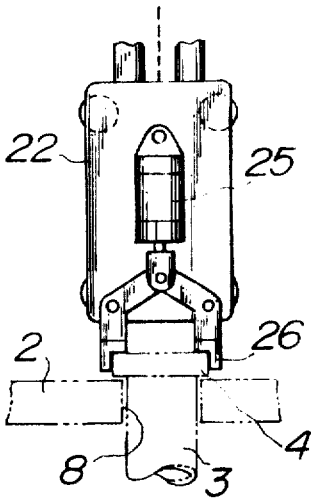
FIG. 2 illustrates in detail a chuck for holding a ceramic filter element shown in FIG. 1.

In FIG. 2 is shown the chuck 22 for holding the filter element 3 in an enlarged scale. As shown in FIG. 2, the chuck 22 is provided at its lower end with forked fingers 26 adapted to be closed and opened by means of an air cylinder 25. The chuck 22 may be replaced by an insert type air chuck (not shown).

The element exchange air tight box means 11 is provided at its open top end with a lamp 27 for illuminating the inside thereof and at its center part with a sight glass 13 through which an operator can observe the inside thereof.

The element exchange air tight box means 11 may be provided at its side surface with a glove 28 which may be used by the operator to manually operate the ceramic filter elements, if necessary.

If much amount of radioactive matter might be accummulated on the inside surface of the filter chamber 1 and on the surface of the filter elements 3, the element exchange air tight box means 11 may preferably be covered with a shielding material such as lead. In addition, provision may be made of a mobile travelling crane adapted to be travelled along a travelling rail instead of the above mentioned travelling crane means 15 driven by the driving shaft means 16, 17. The chain 21 may be replaced by a rope. All of these alternative measures are not shown in the drawing.

The ceramic filter element exchange apparatus constructed as above described according to the invention will operate as follows.

In the case of effecting maintenance, inspection and exchange of the ceramic filter element 3, the waste gas outlet 7 of the radioactive matter containing waste gas treating installation is closed and then an exhaust blower (not shown) is operated in a direction opposite to the direction during the treatment to suck out air in the filter chamber 1 through the waste gas inlet 6 to make the inside of the filter chamber 1 negative in pressure.

Then, the cover 9 shown in FIG. 6 is gradually displaced in one direction in FIG. 1 while the ceramic filter element exchange apparatus according to the invention made in contact with the cover 9 is displaced along the seal face 10 so as to be disposed on the filter chamber 1 and is secured thereto in a sealed manner. Then, the lamp 27 is ignited and the travelling crane means 15 is moved by operating the driving shaft means 16, 17 by the control of the switch box 18 so as to align the travelling crane means 15 with the upper part of the ceramic filter element 3 to be inspected or exchanged while observing it through the sight glass 13. Subsequently, the chain driving motor 24 is rotated to lower the chuck 22 for holding the filter element 3 until its forked fingers 26 grasp a flange 4 formed at the top end of the filter element 3. All these operations are remotely controlled by operating the switch box 18. After the forked fingers 26 have grasped the flange 4 of the filter element 3, the rotation of the chain driving motor 24 is reversed so as to raise the filter element 3 through the element setting hole 8 of the support plate 2. When it is seen by inspection of the filter element 3 that the filter element 3 is required to be exchanged for a new one, a normally closed discharge hole 29 provided for the support plate 2 is made open. Then, the filter element 3 is brought into alignment with the discharge hole 29 and the forked fingers 26 are made open to drop the filter element 3 downwardly by its own weight through the discharge hole 29 into the lower part of the filter chamber 1.

When the filter element 3 is dropped into the lower part of the filter chamber 1, a bottom plate 30 provided for the filter chamber 1 becomes opened. As a result, the filter element 3 is dropped through the bottom plate 30 thus opened into a storage drum (not shown) provided for the lower part of the waste gas treating installation.

Then, the filter element supplying box 12 enclosing a new filter element 3' therein is introduced into the element exchange air tight box means 11. Subsequently, the forked fingers 26 of the chuck 22 for holding the filter element 3 are caused to grasp the flange 4' of the new filter element 3' and move it to a given position where it is lowered down. As a result, the new filter element 3' is inserted into the element setting hole 8 to complete the exchange of the filter element. The above mentioned operation is repeated until all the spent filter elements 3 are exchanged for new ones 3'. Then, the ceramic filter element exchange apparatus according to the invention is removed and then the top open end of the treating installation is closed by the cover 9 shown in FIG. 6 and the bottom part thereof is closed by the bottom plate 30, thereby completing the exchange operation of all the ceramic filter elements.

The ceramic filter treating apparatus, according to the invention, for a radioactive matter containing waste gas treating installation comprises a crusher means having an upper dimension which permits the bottom plate of the treating installation to be opened and closed in an air tight manner and for pulverizing the filter element, and a container means arranged closely adjacent to the bottom of the crusher means and for receiving crushed pieces therein.

The treating apparatus is arranged closely adjacent to the bottom of the treating installation.

The upper part of the crusher means, i.e., the part having a dimension which permits the bottom plate of the treating installation, may preferably be separated from the crusher means and constitutes a glove box means.

FIG. 1 is shown one embodiment of the ceramic filter element treating apparatus according to the invention arranged closely adjacent to the bottom of the treating installation. A glove box means 31 is arranged closely adjacent to the bottom of the filter chamber 1 and has a dimension which permits a bottom plate 30 of the filter chamber 1 to be opened and closed in an air tight manner. The glove box means 31 is provided at its one side with an exhaust duct 32 connected to an exhaust fan and a sight glass 41 (not shown). Closely adjacent to the bottom of the glove box means 31 is connected a crusher means 33 including a crusher such as a roll crusher. The lower part of the crusher means 33 is air tightly connected through a container means 34 to a container 36. The container 36 is mounted on a jack 35 and serves to receive crushed pieces. The container means 34 may be provided with a sight hole (not shown) for observing the crushed spent filter element received therein.

In accordance with the apparatus shown in FIG. 1, when the ceramic filter element 3 becomes clogged with the radioactive matter during the normal operation to an extent such that the element 3 could no longer be used, the bottom plate 30 closing the bottom opening of the filter chamber 1 becomes opened, then the waste gas inlet 6 is closed and subsequently the filter chamber 1 is evacuated through the exhaust duct 32 of the glove box means 31 to a negative pressure. Then, the spent ceramic filter element 3 is dropped through the open bottom plate 30 onto the crusher driven by a motor 37. The spent ceramic filter element 3 is pulverized into fine pieces and received in the container 36 of the container means 34.

The size of the pulverized particles is determined by the rotating speed of the crusher and a gap between the crushing rolls and may be selected to any suitable size which is at most few centimeters.

The ceramic filter element treating apparatus comprising the glove box means 31, crusher means 33 and container 34 may be supported by wheels 38 and moved toward the bottom of the filter chamber 1 and connected thereto in a sealed manner.

The glove box means may be included in the crusher means.

In the radioactive matter containing waste gas treating installation according to the invention, provision may be made of a device having a sealed joint structure which includes a heat resistant packing sandwiched between the support plate and the flange formed at the top of the ceramic filter element. The packing may be a ring-shaped sheet made of a heat resistant ceramic filter. The heat resistant packing may be provided on its upper part with a heat resistant mortar layer secured thereto in a sealed manner. The heat resistant mortar layer may eventually be omitted and use may be made of the heat resistant packing only for sealing the gap between the ceramic filter element and the support plate. In this case, the ceramic filter does not lower its collection efficiency for collecting submicron aerosol. This face renders it possible to omit the heat resistant mortar layer.

Figure 3:
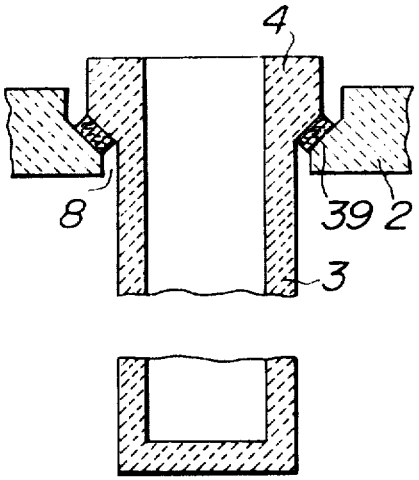
FIGS. 3, 4 and 5 are vertical sections each showing that part of a ceramic filter element which is mounted on a support plate.

In FIG. 3 is shown one embodiment of the above mentioned sealed joint structure according to the invention. In the present embodiment, the flange 4 of the ceramic filter element 3 is tapered at its lower peripheral edge and a ring-shaped packing 39 made of heat resistant ceramic fiber is sandwiched between the tapered portion of the flange 4 and the support plate 2. The ceramic filter element 3 is urged against the support plate 2 by its own weight through the packing 39, thereby sealing the gap between the flange 4 and the support plate 2.

Figure 4:
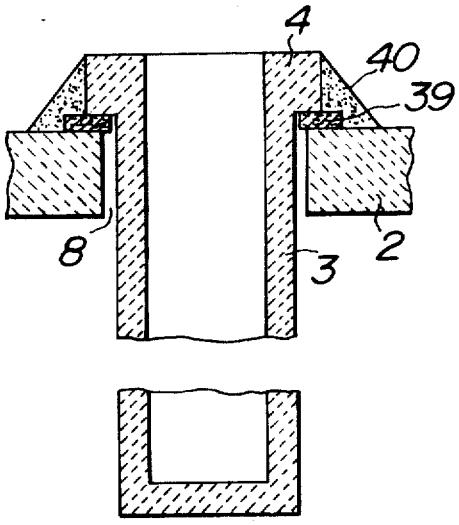
Figure 5:
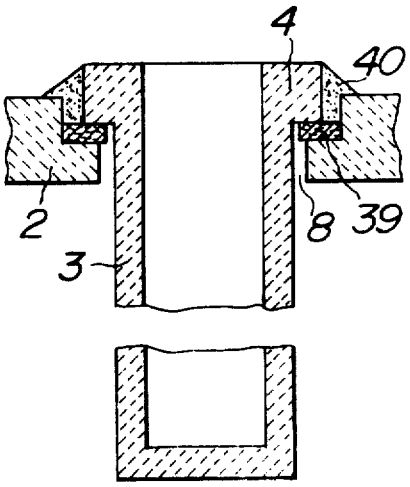

Provision may also be made of a heat resistant mortar layer 40 made of a mixture of fireclay-air set mortar and alumina-silica ceramic fiber as shown in FIGS. 4 and 5. The heat resistant mortar layer 40 may be sandwiched between that part of the support plate 2 which is disposed on the heat resistant packing 39 and the flange 4 for the purpose of reliably seal the gap formed between the support plate 2 and the flange 4. The mortar layer 40 serves to fix the ceramic filter element 3 and seal the gap formed between its flange 4 and the support plate 2 with the aid of the heat resistant packing 39. That is, the present embodiment provides a device having a double sealed joint structure composed of the heat resistant packing 39 and the heat resistant mortar layer 40 eventually added thereto.

In FIG. 4 is shown another embodiment of the sealed joint structure according to the invention. In the present embodiment, the flange 4 shown in FIG. 3 is made rectangular in section and the heat resistant packing 39 is sandwiched between two flat surfaces of both the support plate 2 and the flange 4 and the mortar layer 40 is made substantially triangular in section.

In FIG. 5 is shown a further embodiment of the sealed joint structure according to the invention. In the present invention, both the flange 4 and the heat resistant packing 39 are made similar to those shown in FIG. 4, but the support plate 2 is provided at its opposed end surfaces with a step-shaped notch so as to reliably hold the resistant packing 39 in the gap formed between the step-shaped notch of the support plate 2 and the flange 4.

The ring-shaped heat resistant packing 39 may preferably be fitted around the flange 4 of the ceramic filter element 3 with eventually the heat resistant mortar layer 40 adhered to the upper part of the heat resistant packing 39 so as to make them into one integral unit. As a result, only insertion of the ceramic filter element 3 into the element setting hole 8 ensures a positive mounting thereof on the support plate 2 and provides the important advantage that the above mentioned double sealed joint structure can easily be obtained, and that the mounting of the ceramic filter element 3 on the support plate 2 may completely be automated by remote controllable manner.

As stated hereinbefore, the invention has a number of advantages. In the first place, the ceramic filter element exchange apparatus causes the filter element to be maintained, inspected and exchanged mechanically by remote control from outside in a simple, rapid and reliable manner. Secondly, it is possible to prevent the radioactive dust adhered to the inside wall of the filter chamber from being scattered toward outside during exchange of the filter element, and prevent radioactive contamination of the operating house and operator's clothes. Third, there is no risk of an operator being subjected to radiation internal exposure even when he works without wearing a dusk mask. The ceramic filter element treating apparatus causes the ceramic filter element contaminated with the radioactive matter to be mechanically pulverized, and as a result, there is no risk of radiation external exposure being occurred. And the finely divided particles render it possible to effect after treatment of solidifying these particles in an extremely easy manner, thereby densely collecting these particles into a container. The crushing power for pulverizing the ceramic filter element can be made significantly higher than that of the prior art method.

In addition, the radioactive matter containing waste gas treating installation according to the invention is capable of sealing the gap formed between the ceramic filter element and the support plate with the aid of the heat resistant packing which also serves to secure the ceramic filter element to the support plate, mounting the ceramic filter element on the support plate in a simple manner while inspecting the mounting operation and hence mechanically performing the mounting operation by remote control, and completing the mounting operation in a short time even when it is effected in the glove box.

Though specific embodiments have been shown and described, it is to be understood that they are illustrated only, and are not to be construed as limiting the scope and spirit of the invention.

What is claimed is:

1. A radioactive matter containing waste gas treating installation comprising, in combination:

A. a ceramic filter element exchange device including;
   1. an air-tight box means with a filter element supplying box having a sight glass
   2. a traveling crane means driven by a driving shaft means arranged in the upper part of the box means, and
   3. a lifting means carried by the frame means for suspending a chuck for holding a filter element and raising and lowering said element, to exchange it for a new element and;

B. a spent ceramic filter treatment system including;
   1. a spent ceramic filter receiving chamber having an upper dimension with a bottom plate, said bottom plate openable and closeable in an air-tight manner
   2. a crusher chamber, the top of which is defined by said bottom plate and including crusher means for pulverizing said filter element and, 3. a container means located closely adjacent to the bottom of the crusher means for receiving crushed pieces.

2. An apparatus as claimed in claim 1, wherein the box means further has glove means.

3. An apparatus as claimed in claim 1, wherein the box means further has inside illuminating means.

4. An apparatus as claimed in claim 1, wherein the box means is covered with a radiation shielding material.

5. An apparatus as claimed in claim 4, wherein the shielding material is lead.

6. An apparatus as claimed in claim 1, wherein the crusher means comprises a roll crusher.

7. An apparatus as claimed in claim 1, wherein the crusher means is covered with a radiation shielding material.

8. An apparatus as claimed in claim 1, wherein the container means is covered with a radiation shielding material.

9. An apparatus as claimed in claim 1, wherein the apparatus further comprises a glove box means provided between the installation and the crusher means.

10. An apparatus as claimed in claim 9, wherein the glove box means has an exhaust duct.

11. An apparatus as claimed in claim 9, wherein the glove box means further has a sight glass.

* * * * *